US009589547B2

(12) United States Patent
Koster

(10) Patent No.: US 9,589,547 B2
(45) Date of Patent: Mar. 7, 2017

(54) RELEASABLY SECURABLE END PIECE

(71) Applicant: Hogjim, LLC, Laramie, WY (US)

(72) Inventor: Kyle Douglas Koster, Laramie, WY (US)

(73) Assignee: Hogjim, LLC, Laramie, WY (US)

( * ) Notice: Subject to any disclaimer, the term of this patent is extended or adjusted under 35 U.S.C. 154(b) by 0 days.

(21) Appl. No.: 14/807,337

(22) Filed: Jul. 23, 2015

(65) Prior Publication Data

US 2016/0027417 A1 Jan. 28, 2016

Related U.S. Application Data

(60) Provisional application No. 62/028,899, filed on Jul. 25, 2014.

(51) Int. Cl.

| | |
|---|---|
| ***G10D 3/00*** | (2006.01) |
| ***G10G 5/00*** | (2006.01) |
| ***A44B 13/00*** | (2006.01) |
| ***A44B 11/25*** | (2006.01) |

(52) U.S. Cl.

CPC ..... *G10G 5/005* (2013.01); *A44B 11/2584* (2013.01); *A44B 13/0023* (2013.01); *A44B 13/0058* (2013.01); *A44B 13/0076* (2013.01)

(58) Field of Classification Search

USPC ..... 84/327

See application file for complete search history.

(56) References Cited

U.S. PATENT DOCUMENTS

| | | | | |
|---|---|---|---|---|
| 4,993,127 | A * | 2/1991 | Mechem | A45C 13/30 224/257 |
| 6,169,238 | B1 | 1/2001 | Bolo, III | |
| 6,590,145 | B2 * | 7/2003 | Doiron | G10G 5/005 84/327 |
| 7,045,694 | B2 * | 5/2006 | Yasunori | A44B 11/2584 24/633 |
| 7,562,422 | B2 | 7/2009 | D'Addario et al. | |
| 7,781,656 | B2 * | 8/2010 | Furuta | G10G 5/005 224/257 |
| 7,818,851 | B2 | 10/2010 | Perrotta | |
| 7,888,572 | B2 * | 2/2011 | Rosenberg | G10G 5/005 84/327 |

* cited by examiner

*Primary Examiner* — Christopher Uhlir
(74) *Attorney, Agent, or Firm* — Lee & Hayes, PLLC

(57) ABSTRACT

This disclosure generally pertains to various end pieces for releasably securing to a coupling element. In at least one example, the end piece may be used for releasably securing a guitar strap to a coupling element on a guitar. In various examples, the end piece can include a body having a first surface opposite a body having a second surface, a first aperture defining a first aperture opening communicating between the body first and second surfaces, and a plurality of resiliently flexible projection elements extending radially inward and spaced apart relation from the first aperture.

19 Claims, 10 Drawing Sheets

RELEASABLY SECURABLE END PIECE

RELATED APPLICATIONS

This application claims priority to U.S. Provisional Application No. 62/028,899, filed on Jul. 25, 2014, the entire contents of which are incorporated herein by reference.

BACKGROUND

Conventional guitar strap connectors typically consist of an opening punched into the end of a strap. The opening may be forced over a standard guitar strap button, relying on the stiffness of the strap connector material, such as leather, to keep the strap from accidentally slipping off the button. Under heavy or repeated use, the stiffness of the strap connector material may lessen and the strap connector may fail, resulting in possible damage to the instrument.

Some guitar strap connectors have addressed this problem by reinforcing the opening, but these guitar strap connectors may still fail when the button accidentally slides into a wider section of the opening. Further, still other guitar strap connectors have attempted to prevent this sliding by physically blocking off the wider part of the opening after the connector engages with the button. However, since multiple styles of buttons exist, users may be forced to purchase a separate connector for each button style. Moreover, some of these blocking mechanisms may be bulky and unattractive.

SUMMARY OF THE INVENTION

This disclosure generally pertains to various end pieces for releasably securing to a coupling element. The end pieces described herein can include a body configured to securely attach to a first coupling element, such as a button. In some examples, the body can be configured to securely attach to a separate element, such as a strap. In at least one example, the end piece may be used for releasably securing a guitar strap to one or more buttons on an instrument, such as a guitar.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

FIG. 2A depicts the end piece in a first position. FIG. 2B depicts the end piece in a second position.

DETAILED DESCRIPTION

Overview

This disclosure generally pertains to various end pieces for releasably securing to a coupling element and various methods for using the end pieces. In various examples, the end piece can include a body. The body can include a first aperture with multiple flexible projection elements and a second aperture. In some examples, the first aperture and the second aperture can be separated by one or more catch elements (e.g., tab, flexible protrusions, etc.). In such examples, the one or more catch elements can define an opening for the second aperture.

Additionally, the body can include a linking member. The linking member can enable a connection between the end piece and a separate element. For example, the linking member can comprise an elongated pass-through shaped to fit an end of a strap, thereby enabling the connection of the strap to the end piece. In at least one example, the end pieces may be used for releasably securing a strap to one or more coupling elements on an instrument, such as a guitar.

In various examples, the body can comprise an outer body and an inner body. In some examples, the outer body and the inner body may be arranged directly adjacent to one another, and may comprise different materials. In other examples, the outer body and the inner body may comprise the same materials. In at least one example, the outer body may be over-molded to the inner body.

Following the "Overview," the disclosure continues with a section entitled "Example Environment," which describes non-limiting examples of an environment in which the end pieces may be used. After the environment discussion, the disclosure continues with a section entitled "Example End Pieces," which describes non-limiting examples of releasably securable end pieces. Finally, the discussion ends with a "Conclusion."

This brief overview, including section titles and corresponding descriptions, is provided for the reader's convenience and is not intended to limit the scope of the claims. The features of the described end pieces and corresponding methods may be implemented in any number of forms. The example end pieces and corresponding methods described herein are merely illustrative. The implementations described herein are not mutually exclusive and aspects of the various implementations may be combined to arrive at other implementations within the scope of the claims. The features, functions, and advantages that have been discussed above and/or will be discussed below are merely examples that may, but need not necessarily, be achieved by releasably securable end pieces according to one or more implementations described herein. Further details of various example implementations are set forth below with reference to the following description and drawings.

Example Environment

Figure 1:
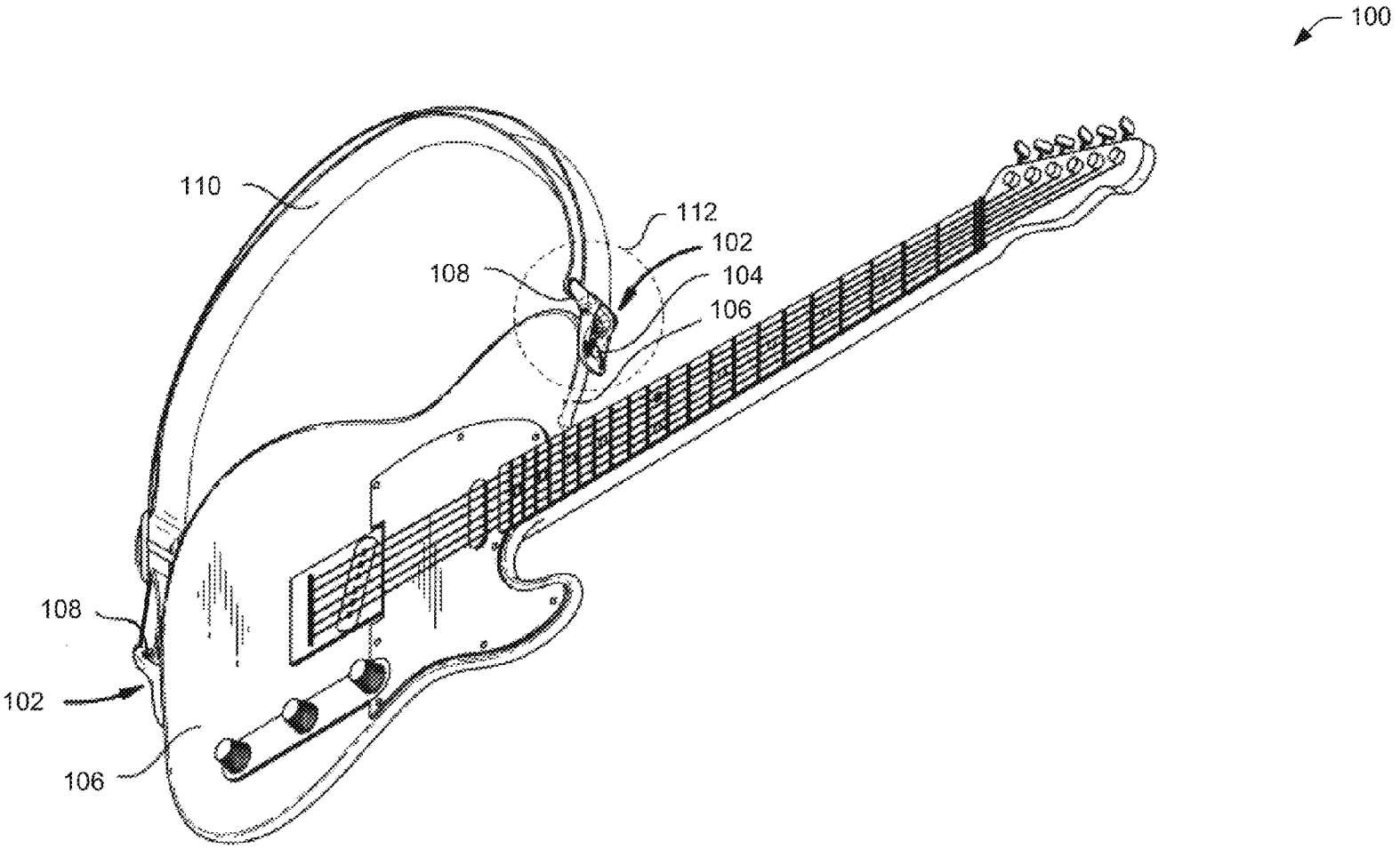
FIG. 1 is a perspective view of an example environment in which a releasably securable end piece can be used, in accordance with some examples of the present disclosure.

FIG. 1 is a perspective view of an example environment 100 in which an end piece 102 can be used. In various examples, an end piece 102 can be configured to securely attach to a first coupling element 104. As shown in FIG. 1, the first coupling element 104 can include a button. In other examples, the first coupling element 104 can include a hook, a magnet, or another type of coupling element.

As illustrated in FIG. 1, two end pieces 102 can be securely attached to a guitar 106, each releasably securing to a respective first coupling element 104 (e.g., a button on the guitar). The end pieces 102 can include a linking member 108 to securely attach the end piece 102 to a separate element 110 (e.g., a strap). In some examples, two or more linking members 108 on the end pieces 102 can couple to the same coupling element, such as a strap (e.g., two or more end pieces can operate together as a kit). In other examples, the linking members 108 on the end pieces 102 can couple to respective separate elements 110. For example, a potted plant may hang from two separate coupling elements, each securely attached to an end piece on opposite sides of the potted plant.

In some examples, a greater or fewer number of end pieces can be securely attached to an object. In other examples, two or more end pieces 102 can be used to securely attach to multiple objects, such as, for example, to connect multiple objects together. For example, two end pieces can be securely attached to a guitar, and a third securely attached to a bag for carrying sheet music.

In the illustrative example, the end pieces 102 can releasably secure to the first coupling elements 104 at a first end and a second end of the guitar 106. In various examples, the end pieces 102 can releasably secure to first coupling elements 104 located at various other places on the guitar. As an illustrative example, the first end section 112 will be explained in greater detail with respect to FIGS. 2A and 2B. However, it is understood that the first end section 112 and a second end section can be substantially similar.

Figure 2A:
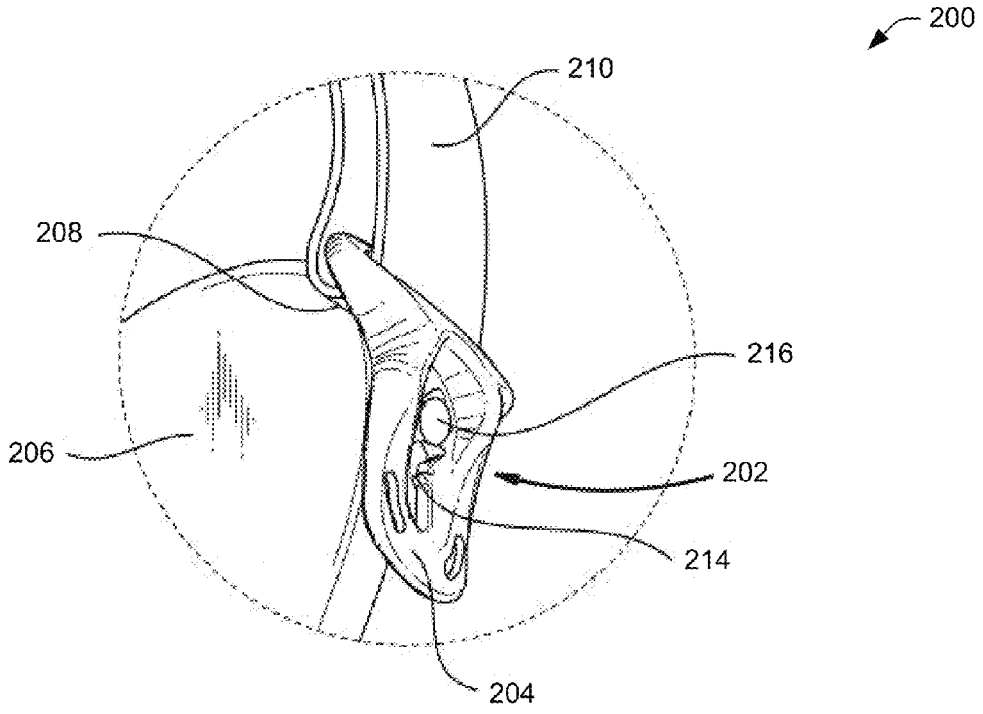
FIGS. 2A and 2B are perspective views of an illustrative method of securing an end piece, in accordance with some examples of the present disclosure.
Figure 2B:
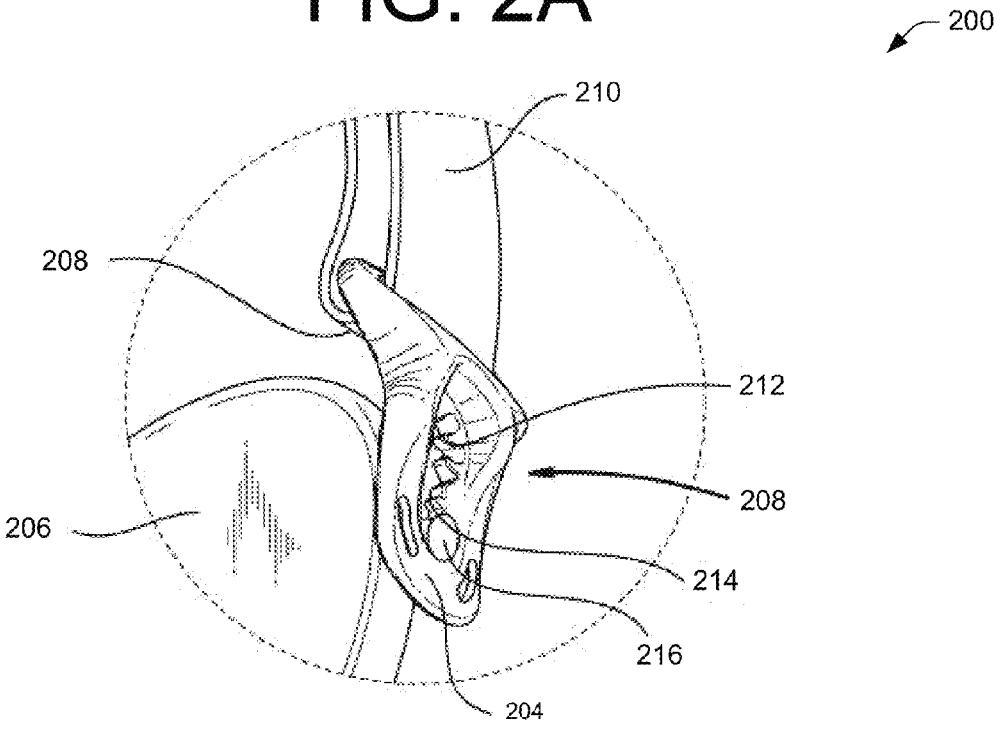

FIGS. 2A and 2B are perspective views of an illustrative method 202 of securing an end piece 202 to an object. FIG. 2A depicts the end piece 200 in a first position. FIG. 2B depicts the end piece 202 in a second position.

As depicted in FIGS. 2A and 2B, the end piece 202 can include a body 204. In various examples, the body 204 can be manufactured via traditional manufacturing techniques. In some examples, the body 204 can be manufactured by 3-D manufacturing techniques, printing, press molding, injection molding, fabrication, machining, over-molding, composite manufacturing, or another method of manufacturing. The body 204 can comprise a single piece, or it can be assembled from two or more pieces. In at least one example, the body 204 can be manufactured by over-molding an outer body to an inner body.

The body 204 can be formed from any of a wide variety of materials, including substantially inflexible materials, resiliently flexible materials, or the like, or combinations thereof. By way of non-limiting examples, the material can include: elastomer, elastomer-like material, rubber, rubber-like material, plastic, plastic-like material, acrylic, polyamide, polyester, polypropylene, polyvinyl chloride-based materials, silicone-based materials, or the like, or combinations thereof.

In various examples, the body 204 can be formed from a material which precludes the body 204 from damaging a surface which the body 204 disposes adjacent to, such as guitar 206. For example, the material can preclude the body 204 from scratching the guitar 206. Additionally, the material can preclude the body 204 from engaging with the guitar 206 so as to generate an undesirable sound, such as a rattling sound or clanking sound.

In various examples, the body 204 may include a resistance or frictional surface and/or material on a bottom side between the body 204 and the guitar 206. The frictional surface and/or material may prevent the body 204 from moving in relation to the guitar 206 without a threshold force applied by a user, for example. In some examples, the frictional surface and/or material may be connected to or manufactured with the body 204. In some examples, the frictional surface and/or material may be a separate component, placed on a bottom side of the body 204.

Examples of the frictional material can include rubber, polyurethane, nylon, Teflon, silicone, polypropylene, acrylonitrile butadiene styrene (ABS), polyethylene or the like. Frictional material can be chosen to have a desired static and/or kinetic frictional properties based on desired resistance to movement (i.e., the desired threshold force that must be applied by the user to move the end piece relative to the coupling element of the guitar).

In various examples, the body 204 can comprise a linking member 208. The linking member 208 can comprise a hole, a slot, or another type of pass-through. The linking member 208 can be substantially rectangular, ovular, circular, square, or another shape capable of housing the separate element 210. The separate element 210 can include a strap, webbing, rope, twine, or another material used for securing equipment. For example, a strap can be fed though the linking members of two end pieces to create a carrying strap for a guitar (110 of FIG. 1).

Figure 3:
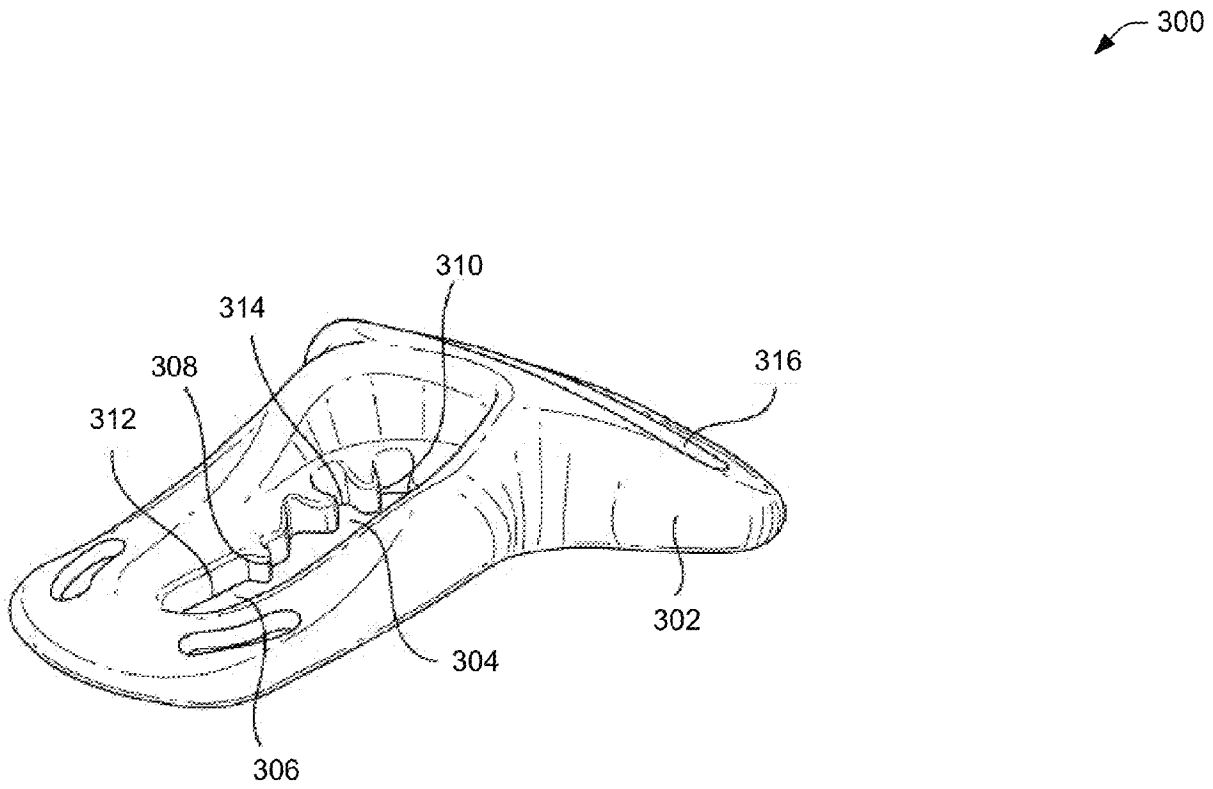
FIG. 3 is a perspective view of an example embodiment of an end piece, in accordance with some examples of the present disclosure.

In various examples, the body 204 can include a first aperture (304 in FIG. 3) with multiple flexible projection elements 212 (FIG. 2B) and a second aperture (306 in FIG. 3). In some examples, the first aperture and the second aperture can be separated by one or more catch elements 214 (e.g., tab, flexible protrusions, etc.).

As shown in FIG. 2A, the first aperture can define any of a wide variety of numerous configurations which can be capable of insertingly receiving any of a corresponding wide variety of numerous configurations of coupling elements, such as coupling element 216. By way of non-limiting examples, the first aperture can define a circle, an oval, an ellipse, a triangle, a square, a rectangle, a trapezoid, a polygon, or the like, or combinations thereof. As an illustrative example, the first aperture can define a circle, which can insertingly receive a substantially circular coupling element 216 coupled to the guitar 206.

As to particular embodiments including a first aperture which defines a circle capable of insertingly receiving a substantially circular coupling element 216 coupled to the guitar 206, the first aperture can have dimensions capable of receiving coupling elements 216 having a wide variety of dimensions. In at least one example, a particular embodiment of the body piece 204 can include a resiliently flexible first aperture defining a circle having a diameter of about 20 millimeters. Accordingly, the resiliently flexible first aperture can insertingly receive substantially circular coupling elements 216 having diameters ranging from between about 5 millimeters to about 25 millimeters.

As shown in FIG. 2A, the first aperture can insertingly receive the coupling element 216 in a first position. The end piece 200 can be adjusted in such a way that the coupling element 216 can be moved from the first position in the first aperture to a second position in the second aperture depicted in FIG. 2B.

In various examples, the first aperture and the second aperture can be separated by two or more catch elements 214. In such examples, the two or more catch elements 24 can define an opening for the second aperture. As illustrated in FIGS. 2A and 2B, the catch elements 214 can be substantially horizontal pieces extending inward from the body 204. In some examples, the catch elements 214 can be implements that extend in a substantially vertical direction (618 in FIG. 6). The catch elements 214 can be formed of a same material as the body 204. In some examples, the catch elements 214 can be formed of a different material. In such examples, the catch elements 214 can be a part of the inner body.

In various examples, the catch elements 214 can provide a locking mechanism to firmly secure the coupling element 216 in the second position shown in FIG. 2B. In such examples, the catch elements 214 may require a threshold amount of lateral force applied to move the coupling element 216 from the second position to the first position. In at least one example, the threshold amount of lateral force can be between 5-15 pounds (lbs) of force.

Example End Pieces

FIG. 3 is a perspective view of an example embodiment of an end piece 300, similar to end piece 100/200. As described above, end piece 300 can include a body 302 with a first aperture 304 and a second aperture 306 separated by catch elements 308.

The body 302 can be formed from any of a wide variety of materials, including substantially inflexible materials, resiliently flexible materials, or the like, or combinations thereof. By way of non-limiting examples, the material can include or consist of: elastomer, elastomer-like material, rubber, rubber-like material, plastic, plastic-like material, acrylic, polyamide, polyester, polypropylene, polyvinyl chloride-based materials, silicone-based materials, or the like, or combinations thereof. As to particular embodiments, the body 302 can be formed from a material which precludes the body 302 from damaging a surface which the body 302 disposes adjacent to, such as an instrument. For example, the material can preclude the body 302 from scratching the instrument surface. Additionally, the material can preclude the body 302 from engaging with the instrument surface so as to generate an undesirable sound, such as a rattling sound or clanking sound.

In various examples, the first aperture 304 can define any of a wide variety of numerous configurations which can be capable of insertingly receiving any of a corresponding wide variety of numerous configurations of coupling elements, such as coupling element 104. By way of non-limiting examples, the first aperture 304 can define a circle, an oval, an ellipse, a triangle, a square, a rectangle, a trapezoid, a polygon, or the like, or combinations thereof. As an illustrative example, the first aperture 304 can define a circle, which can insertingly receive a substantially circular coupling element coupled to an object.

In various examples, the body 302 can further include a plurality of projection elements 310. The projection elements can be resiliently flexible. As shown in FIG. 3, the plurality of projection elements 310 can extend inward from the body 302 and can be spaced apart in relation to the first aperture 304. In at least one example, the plurality of projection elements 310 can extend radially inward from the body 302, and can be spaced such that plurality of projection elements 310 substantially surround about 300 degrees of the first aperture 304.

In various examples, coupling element can be insertingly received by the first aperture 304 having the plurality of projection elements 310. In such examples, the coupling element can slightly displace the plurality of projection elements 310 during insertion. Responsive to a top end of the coupling element passing through the first aperture 304, the plurality of projection elements 310 can return to the stationary position. In some examples, the plurality of projection elements 310 can act as a locking mechanism, requiring a threshold amount of vertical force (e.g., force perpendicular to the end piece) to release the coupling element from the first aperture 304. In some examples, the threshold amount of vertical force may be in a range of about 5-20 lbs of force.

In some examples, the end piece 300 can further include a second aperture 306 communicating with the first aperture 304. The second aperture 306 can define any of a wide variety of numerous configurations which can be capable of releasably retaining any of a corresponding wide variety of numerous configurations of coupling elements. As an illustrative example, the second aperture can be configured as a resiliently flexible elongate aperture, which can releasably retain a substantially circular coupling element coupled to an object (e.g. prevent vertical and/or lateral movement of the coupling element).

Figure 6:
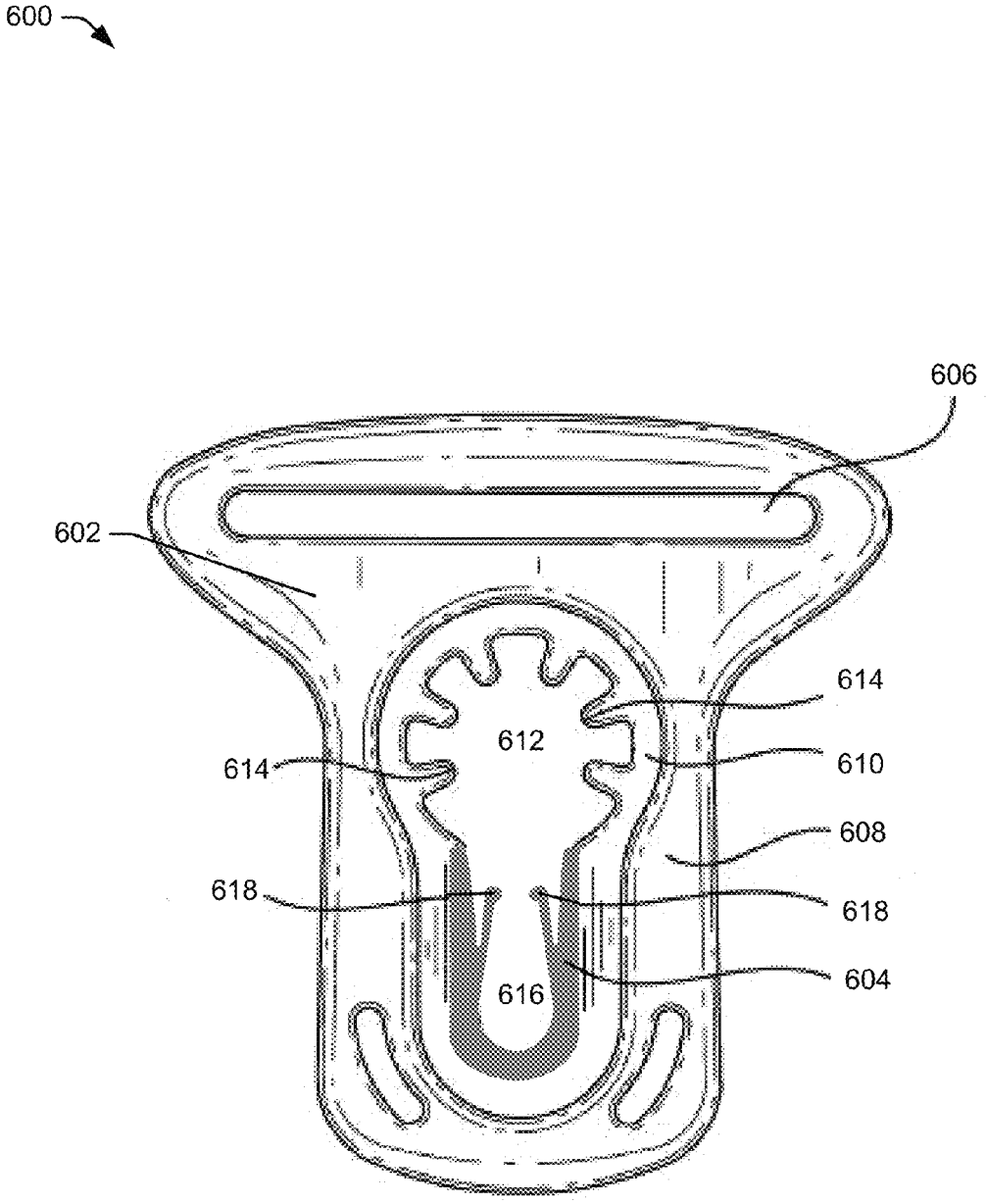
FIG. 6 is a top view of an example embodiment of an end piece, in accordance with some examples of the present disclosure.
Figure 7:
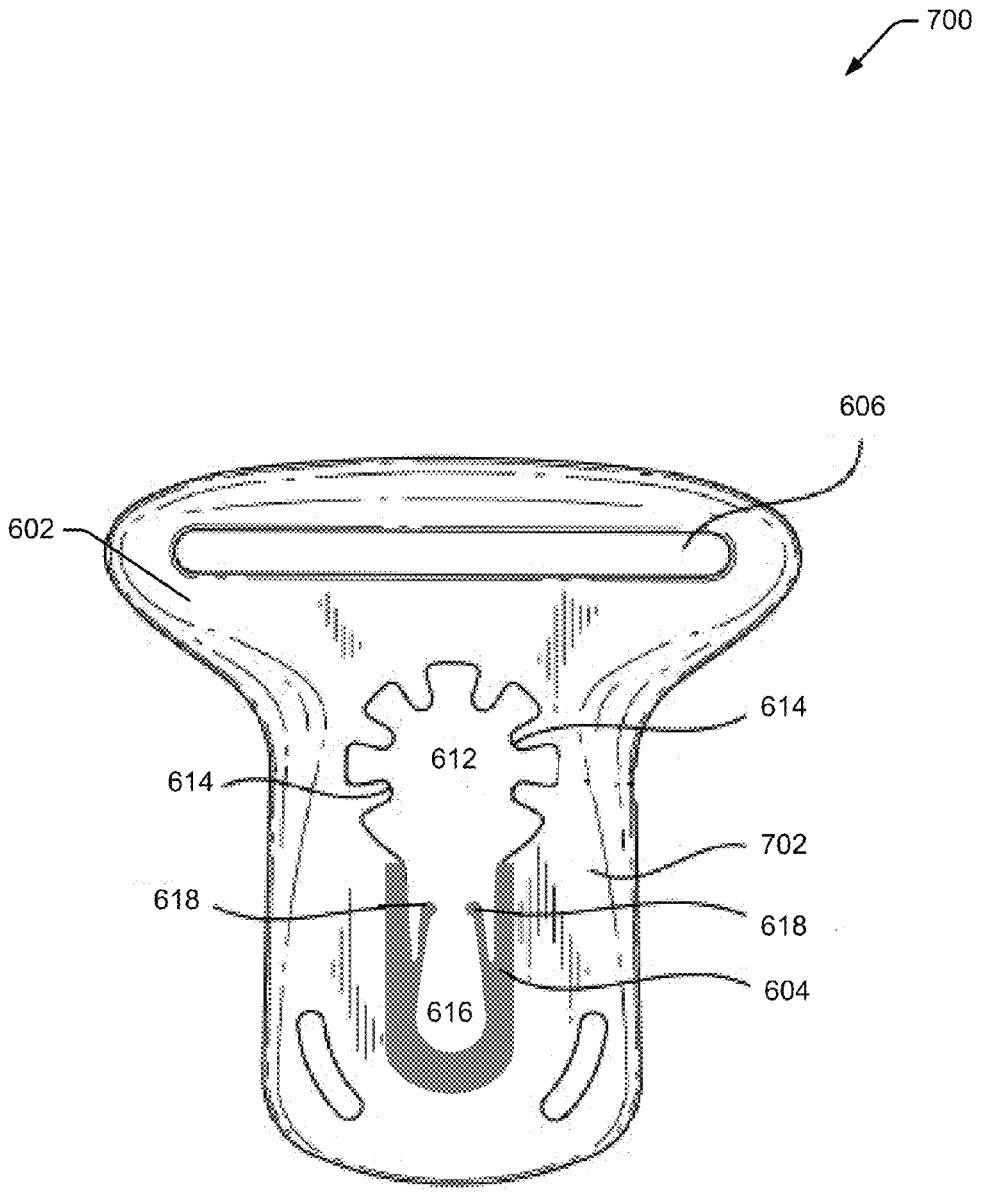
FIG. 7 is a bottom view of the example end piece shown in FIG. 6, in accordance with some examples of the present disclosure.

In various examples, the second aperture 306 can releasably retain a plurality of different coupling elements with one or more catch elements 308. In some examples, the catch elements 308 can include a resiliently flexible protrusion inwardly extending from the body 302. As shown in FIG. 3, the catch element 308 can protrude substantially perpendicular to the body. In other examples, the catch element 308 can protrude in a curved pattern from the body 302 to a substantially parallel position from the body (as depicted in FIGS. 6 and 7).

The catch elements 308 can maintain engagement of the coupling element with by precluding the coupling element from passing from the second aperture 306 to the first aperture 304. As such, the coupling element can be releasably retained within the second aperture 306.

In various examples, the body 302 can include an inner body 312 and an outer body 314. In some examples, the inner body 312 can define the second aperture 306 and the catch elements 308, while the outer body 314 can surround the inner body 312, and define the first aperture. In other examples, the inner body 312 can define the first aperture 304, the plurality of projection elements 310, the second aperture 306, and the catch elements 308, while the outer body 314 can surround the inner body 312 (as shown in FIG. 4).

In some examples, the inner body 312 can be formed of a different material than the outer body 314. In some examples, the inner body 312 can be formed of the same material. In at least one example, the inner body 312 can be formed of nylon, and the outer body 314 can be formed of TPE. In some examples, the outer body 314 can be overmolded around an outer edge of the inner body 312.

In various examples, the end piece 300 can also include a linking member 316, similar to linking member 108. The linking member 316 can enable a secure attachment between the end piece 300 and a separate element, such as a strap for an instrument.

Figure 4:
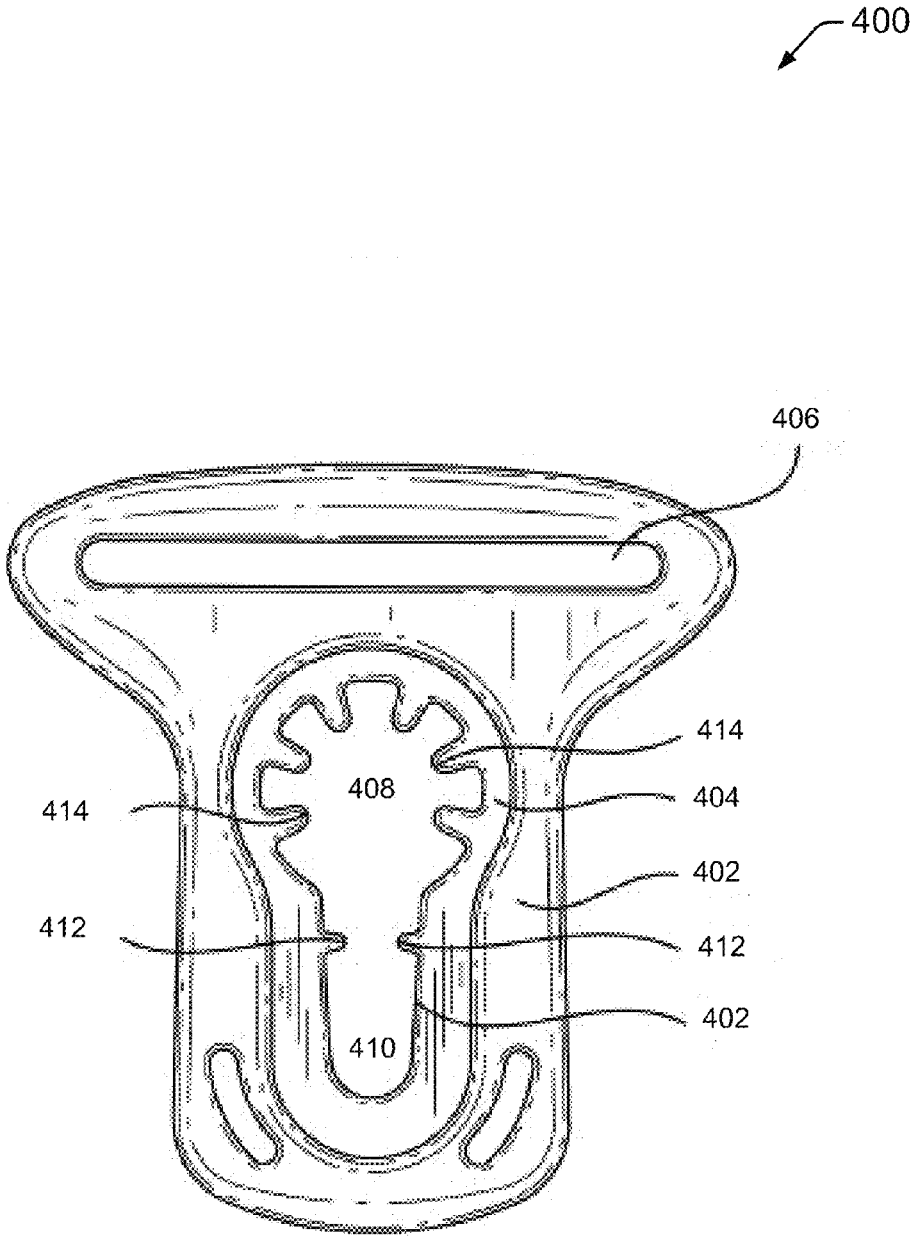
FIG. 4 is a top view of an example embodiment of an end piece, in accordance with some examples of the present disclosure.

FIG. 4 is a top view of an example embodiment of an end piece 400, similar to the end pieces depicted in FIGS. 1-3.

In various examples, the end piece 400 can include an outer body 402 and an inner body 404.

The outer body 402 and the inner body 404 can be formed from any of a wide variety of materials, including substantially inflexible materials, resiliently flexible materials, or the like, or combinations thereof. By way of non-limiting examples, the material can include or consist of: elastomer, elastomer-like material, rubber, rubber-like material, plastic, plastic-like material, acrylic, polyamide, polyester, polypropylene, polyvinyl chloride-based materials, silicone-based materials, or the like, or combinations thereof. The outer body 402 and the inner body 404 can be formed of the same material, or of different materials. In at least one example, the outer body 402 is formed from a TPE material and the inner body 404 is formed from a nylon material.

In some examples, the outer body 402 can include a linking member 406. In such examples, the linking member 406 can enable the end piece 400 to connect to a coupling implement, such as a strap. The linking member 406 can comprise a hole, a slot, or another type of pass-through. The linking member 406 can be substantially rectangular, ovular, circular, square, or another shape capable of housing coupling element, (e.g., a strap, webbing, rope, twine or other material used for securing equipment). In at least one example, a linking member 406 may be used for releasably securing a guitar strap to the end piece 400.

In various examples, the inner body 404 can include a first aperture 408 and a second aperture 410, separated by catch elements 412. The first aperture 408 can define any of a wide variety of numerous configurations which can be capable of insertingly receiving any of a corresponding wide variety of numerous configurations of coupling elements, such as coupling element 104/216. By way of non-limiting examples, the first aperture 408 can define a circle, an oval, an ellipse, a triangle, a square, a rectangle, a trapezoid, a polygon, or the like, or combinations thereof. As an illustrative example, the first aperture 408 can define a circle, which can insertingly receive a substantially circular coupling element coupled to an object.

In various examples, the inner body 404 can further include a plurality of projection elements 414. The projection elements 414 can be resiliently flexible. As shown in FIG. 4, the plurality of projection elements 414 can extend inward from the inner body 404 and can be spaced apart in relation to the first aperture 408. In at least one example, the plurality of projection elements 414 can extend radially inward from the inner body 404, and can be spaced such that plurality of projection elements 414 substantially surround about 300 degrees of the first aperture 408.

In various examples, a coupling element can be insertingly received by the first aperture 408 having the plurality of projection elements 414. In such examples, the coupling element can slightly displace the plurality of projection elements 414 during insertion. Responsive to a top end of the coupling element passing through the first aperture 408, the plurality of projection elements 414 can return to the stationary position. In some examples, the plurality of projection elements 414 can act as a locking mechanism, requiring a threshold amount of force to release the coupling element from the first aperture 408. In some examples, the threshold amount of force may be in a range of about 5-20 lbs of force.

In some examples, the second aperture 410 can define any of a wide variety of numerous configurations which can be capable of releasably retaining any of a corresponding wide variety of numerous configurations of coupling elements. As an illustrative example, the second aperture 410 can be configured as a resiliently flexible elongate aperture, which can releasably retain a substantially circular coupling element coupled to an object (e.g. prevent vertical and/or lateral movement of the coupling element).

In various examples, the second aperture 410 can releasably retain a plurality of different coupling elements with one or more catch elements 412. In some examples, the catch elements 412 can include a resiliently flexible protrusion inwardly extending from the inner body 404. As shown in FIG. 4, the catch elements 412 can protrude substantially perpendicular to the body. In other examples, the catch elements 412 can protrude in a curved pattern from the inner body 404 to a substantially parallel position from the body (as depicted in FIGS. 6 and 7).

The catch elements 412 can maintain engagement of the coupling element with by precluding the coupling element from passing from the second aperture 410 to the first aperture 408. As such, the coupling element can be releasably retained within the second aperture 410.

Figure 5:
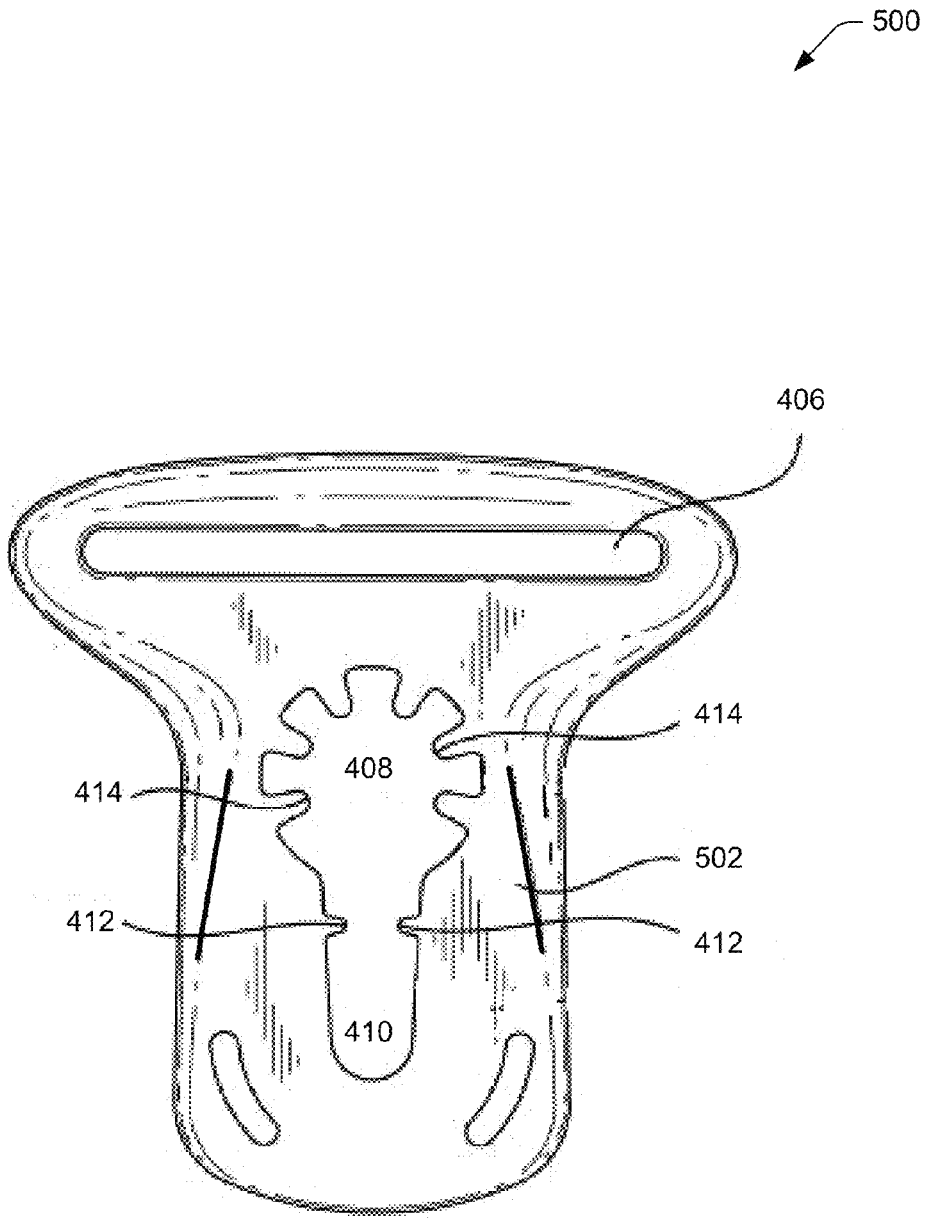
FIG. 5 is a bottom view of the example embodiment of the end piece shown in FIG. 4.

FIG. 5 is a bottom view of the example embodiment of the end piece shown in FIG. 4. As described above with regard to FIG. 4, the end piece 500 can include a linking member 406, a first aperture 408, a plurality of projection elements 414, a second aperture 410, two or more catching elements 412.

In various examples, a bottom surface 502 of the end piece 500 can include a resistance or frictional surface. In some examples, the bottom surface 502 can prevent the end piece 500 from moving in relation to an object without a threshold force applied by a user, for example. In some examples, the frictional material can be connected to or manufactured with a body of the end piece 500. In some examples, the frictional material may be a separate component, placed on a bottom surface 502 of the end piece 500.

Examples of the frictional material can include rubber, polyurethane, nylon, Teflon, silicone, polypropylene, acrylonitrile butadiene styrene (ABS), polyethylene or the like. Frictional material may be chosen to have a desired static and/or kinetic frictional properties based on desired resistance to movement (i.e., the desired threshold force that must be applied by the user to move the end piece relative to the coupling element of the guitar).

FIG. 6 is a top view of an example embodiment of an end piece 600, similar to the end pieces depicted in FIGS. 1-3. In various examples, the end piece 600 can include an outer body 602 and an inner body 604.

The outer body 602 and the inner body 604 (depicted as the shaded area 604) can be formed from any of a wide variety of materials, including substantially inflexible materials, resiliently flexible materials, or the like, or combinations thereof. By way of non-limiting examples, the material can include or consist of: elastomer, elastomer-like material, rubber, rubber-like material, plastic, plastic-like material, acrylic, polyamide, polyester, polypropylene, polyvinyl chloride-based materials, silicone-based materials, or the like, or combinations thereof. The outer body 602 and the inner body 604 can be formed of the same material, or of different materials. In at least one example, the outer body 602 is formed from a TPE material and the inner body 604 is formed from a nylon material.

In some examples, the outer body 602 can include a linking member 606. In such examples, the linking member 606 can enable the end piece 600 to connect to a coupling implement, such as a strap. The linking member 606 can comprise a hole, a slot, or another type of pass-through capable of housing the coupling implement, (e.g., a strap, webbing, rope, twine or other material used for securing equipment). In at least one example, a linking member 606 may be used for releasably securing a guitar strap to the end piece 600.

In various examples, the outer body 602 can include a first section 608 and a second section 610. In such examples, the first section 608 can include the linking member 606, and the second section 610 can include a first aperture 612. The first aperture 612 can define any of a wide variety of numerous configurations which can be capable of insertingly receiving any of a corresponding wide variety of numerous configurations of coupling elements, such as coupling element 104/216. By way of non-limiting examples, the first aperture 612 can define a circle, an oval, an ellipse, a triangle, a square, a rectangle, a trapezoid, a polygon, or the like, or combinations thereof. As an illustrative example, the first aperture 612 can define a circle, which can insertingly receive a substantially circular coupling element coupled to an object.

In various examples, the second section 610 of the outer body 602 can further include a plurality of projection elements 614. The projection elements 614 can be resiliently flexible. As shown in FIG. 6, the plurality of projection elements 614 can extend inward from the second section 610 of the outer body 602 and can be spaced apart in relation to the first aperture 612. In at least one example, the plurality of projection elements 614 can extend radially inward from second section 610 of the outer body 602, and can be spaced such that plurality of projection elements 614 substantially surround about 300 degrees of the first aperture 612.

In various examples, a coupling element can be insertingly received by the first aperture 612 having the plurality of projection elements 614. In such examples, the coupling element can slightly displace the plurality of projection elements 614 during insertion. Responsive to a top end of the coupling element passing through the first aperture 612, the plurality of projection elements 614 can return to the stationary position. In some examples, the plurality of projection elements 614 can act as a locking mechanism, requiring a threshold amount of force (e.g., force perpendicular to the end piece) to release the coupling element from the first aperture 612. In some examples, the threshold amount of force may be in a range of about 5-20 lbs of force.

In various examples, the inner body 604 may be surrounded on an outer edge by the second section 610 of the outer body 602. In some examples the outer body 602 can be over-molded over the inner body 604. In other examples, the outer body 602 can be attached to the inner body 604 by fusing, gluing, anchoring, clamping, press-fitting, or other reasonable method for attaching two surfaces together.

In some examples, inner body 604 can comprise a second aperture 616. The second aperture 616 can define any of a wide variety of numerous configurations which can be capable of releasably retaining any of a corresponding wide variety of numerous configurations of coupling elements. As an illustrative example, the second aperture 616 can be configured as a resiliently flexible elongate aperture, which can releasably retain a substantially circular coupling element coupled to an object (e.g. prevent vertical and/or lateral movement of the coupling element).

In various examples, the second aperture 616 can releasably retain a plurality of different coupling elements with one or more catch elements 618. In some examples, the catch elements 618 can include a resiliently flexible protrusion inwardly extending from the inner body 604. As shown in FIG. 4, the catch elements 618 can protrude in an angled direction from the inner body 604. In various examples, the catch elements 618 can define an opening between the first aperture 612 and the second aperture 616.

The catch elements 618 can maintain engagement of the coupling element with by precluding the coupling element from passing from the second aperture 616 to the first aperture 612, absent a threshold amount of force applied to the catch elements 618. As such, the coupling element can be releasably retained within the second aperture 616. In various examples, the threshold force required to move a coupling element from the second aperture 616 to the first aperture 612 can be in a range from 5-15 lbs. In other examples, the threshold force can be higher or lower.

FIG. 7 is a bottom view of the example end piece shown in FIG. 6. As described above with regard to FIG. 6, the end piece 700 can include a linking member 606, an outer body 602 with a first aperture 612 including a plurality of projection elements 614, and an inner body 604 with a second aperture 616 including two or more catching elements 618.

In various examples, a bottom surface 702 of the end piece 700 can include a resistance or frictional surface. In some examples, the bottom surface 702 can prevent the end piece 700 from moving in relation to an object without a threshold force applied by a user, for example. In some examples, the frictional material can be connected to or manufactured with a body of the end piece 700. In some examples, the frictional material may be a separate component, placed on a bottom surface 702 of the end piece 700.

Examples of the frictional material may include rubber, polyurethane, nylon, Teflon, silicone, polypropylene, acrylonitrile butadiene styrene (ABS), polyethylene or the like. Frictional material may be chosen to have a desired static and/or kinetic frictional properties based on desired resistance to movement (i.e., the desired threshold force that must be applied by the user to move the end piece relative to the coupling element of the guitar).

Figure 8:
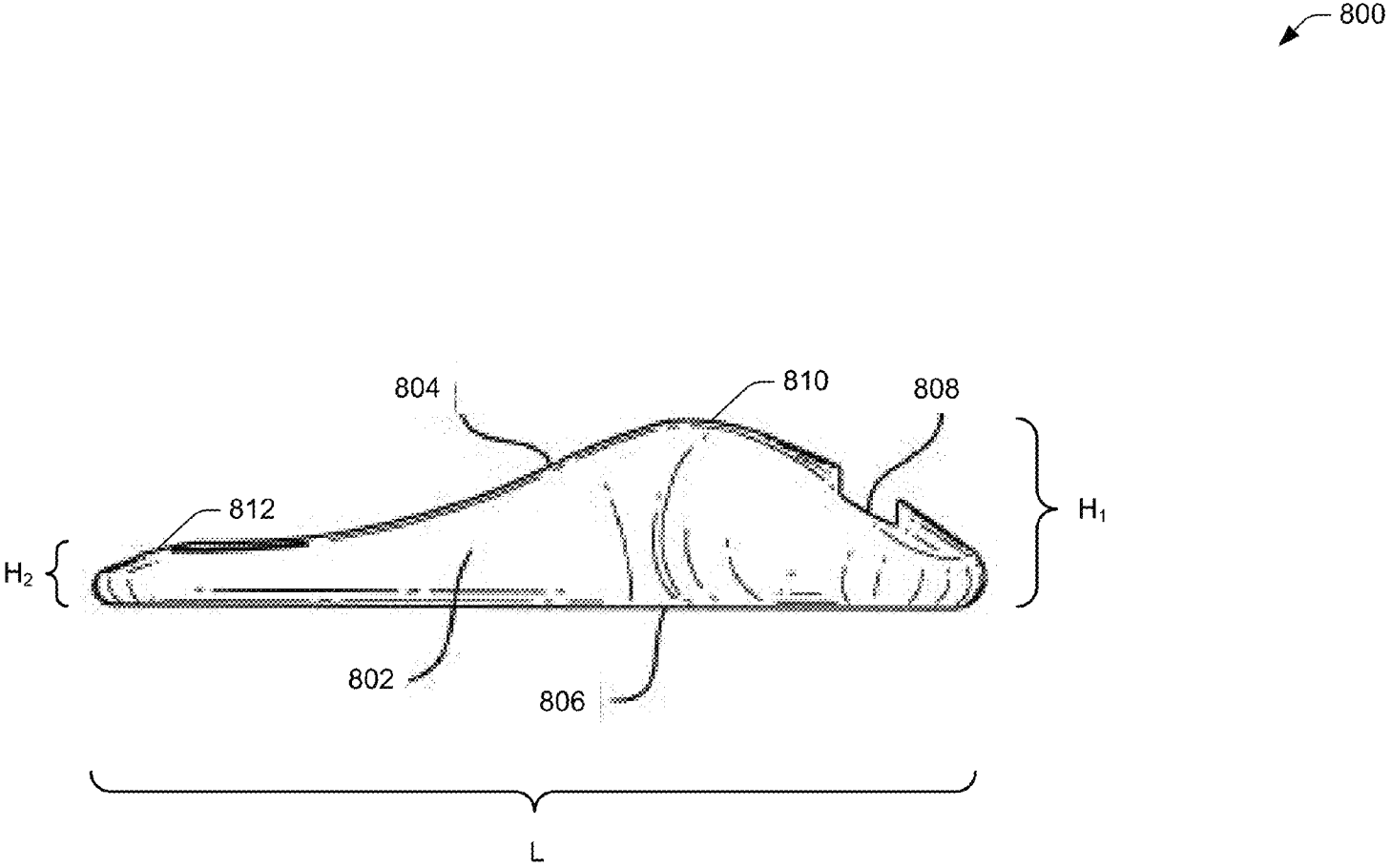
FIG. 8 is a side view of an example embodiment of an end piece, in accordance with some examples of the present disclosure.

FIG. 8 is a side view of an example embodiment of an end piece 800, similar to the end pieces depicted in FIGS. 1-7. In various examples, the body 802 of end piece 800 can include a top surface 804 and a bottom surface 806. In some examples, the top surface 804 can include a linking member 808, such as linking member 108. The linking member 808 can be configured as an elongate pass-through, which can communicate between the top surface 804 and the bottom surface 806. Accordingly, a portion of a coupling element, such as a strap can be passed through the linking member 808 and coupled to the body 802.

As shown in FIG. 8, the top surface 804 can include a substantially rounded first end section 810 with a height $H_1$, and a substantially flat second end section 812 with a height $H_2$. In other embodiments, the first end section 810 and the second end section 812 can be substantially flat, such that a height H of the end piece is decreased. In the illustrative example, $H_1$ is greater than $H_2$. In other examples, $H_1$ can be equal to or greater than $H_2$. In various other examples, the shape, size, diameter and/or other dimensional characteristic of the top surface 804.

In various examples, the bottom surface 806 can include a substantially flat surface of length L. In at least one example, the L can comprise a length of about 2¾ inches. In some examples, the body 802 may be variable in size (e.g., width, length, height, etc.).

In various examples, the bottom surface 806 can include a knurled surface, a ribbed surface, or frictional surface. In various examples, a frictional material can be adhered to the bottom surface 806 to increase friction between the body 802 and an adjacent object. The frictional surface and/or material may prevent the body 802 from moving in relation to the object without a threshold force applied by a user, for example. In some examples, the frictional surface and/or material may be connected to or manufactured with the body 802.

Examples of the frictional material can include rubber, polyurethane, nylon, Teflon, silicone, polypropylene, acrylonitrile butadiene styrene (ABS), polyethylene or the like. Frictional material may be chosen to have a desired static and/or kinetic frictional properties based on desired resistance to movement (i.e., the desired threshold force that must be applied by the user to move the end piece relative to the coupling element of the guitar).

Figure 9:
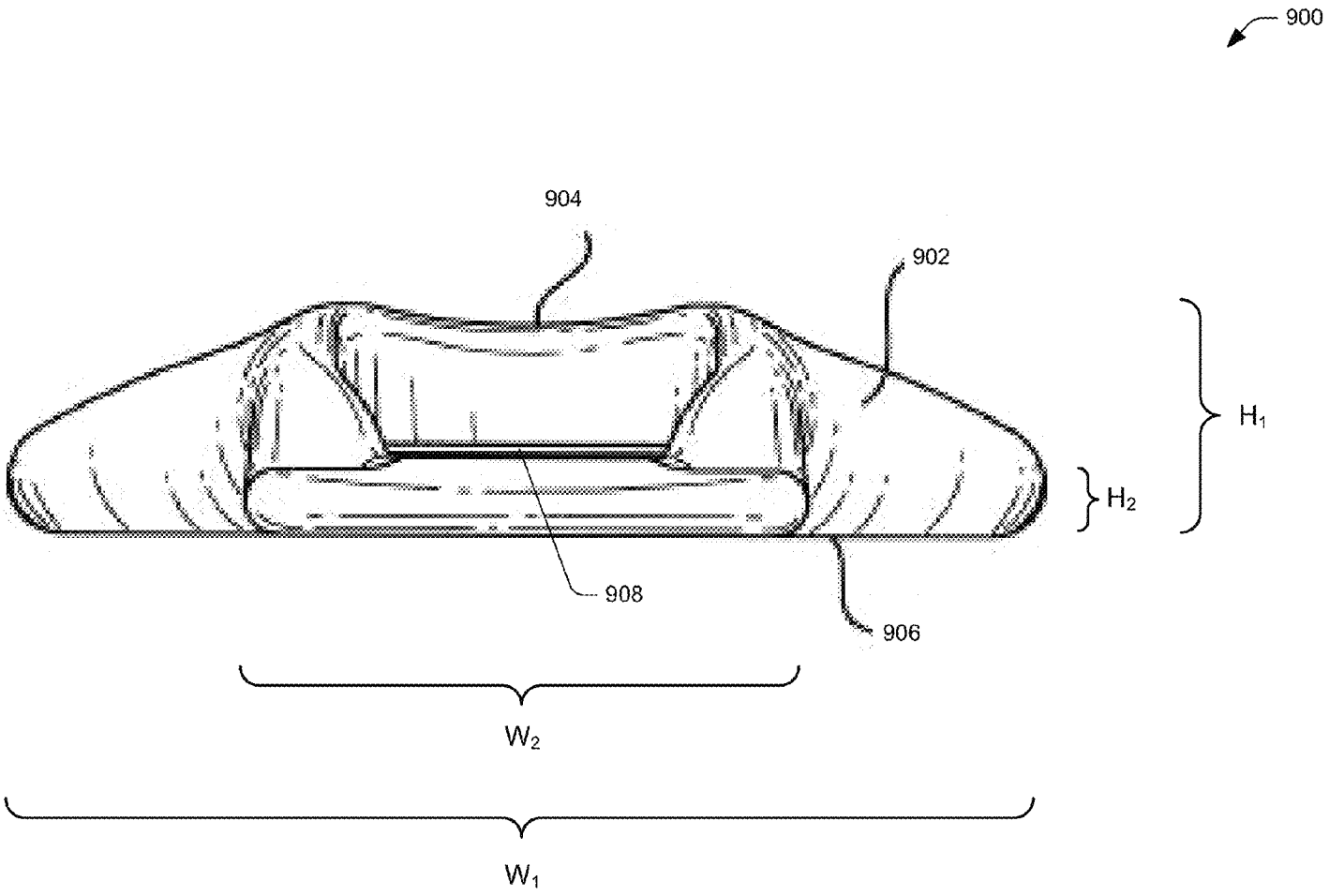
FIG. 9 is a first end view of an example embodiment of an end piece, in accordance with some examples of the present disclosure.

FIG. 9 is a first end view of an example embodiment of an end piece 900, similar to the end pieces depicted in FIGS. 1-8. In various examples, the body 902 of end piece 900 can include a top surface 904 and a bottom surface 906. A first section of the top surface 904 can include a raised section of a height $H_1$, and a second section of the top surface 904 can include a substantially flat section of a height $H_2$. In various examples, the height H of the body 902 can be tapered from a height $H_1$ to a height $H_2$. In at least one example, $H_1$ can include a height of about ½ inch, and $H_2$ can include a height of about 3/16 inch.

In various examples, a first section of the bottom surface 906 can include a width $W_1$, and a second section of the bottom surface 906 can include a width $W_2$. In the illustrative example, $W_1$ is greater than $W_2$. In other embodiments, $W_1$ can be less than or equal to $W_2$. In at least one embodiment, $W_1$ can comprise a width of about 2½ inches and a $W_2$ of about 1⅜ inches. In various examples, the body 902 may be variable in size (e.g., width, length, height, etc.).

In various embodiments, the end piece 900 can include a cutout 908. The cutout 908 can include a first aperture, such as first aperture 304/408/612 and the second aperture, such as second aperture 306/410/616.

Figure 10:
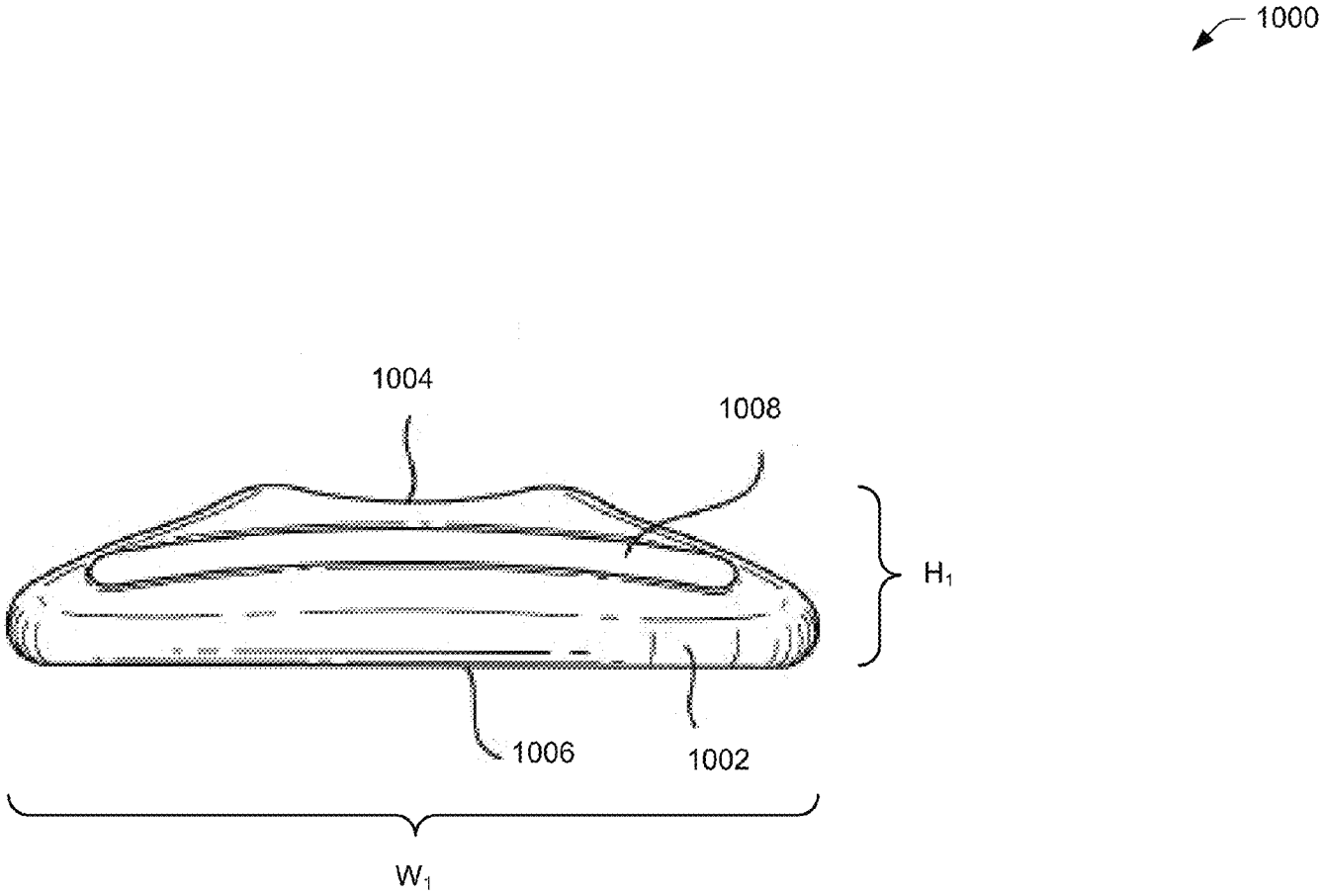
FIG. 10 is a second view of an example embodiment of an end piece, in accordance with some examples of the present disclosure.

FIG. 10 is a second view of an example embodiment of an end piece 1000, similar to the end pieces depicted in FIGS. 1-9. In various examples, the body 1002 of end piece 1000 can include a top surface 1004 and a bottom surface 1006. The top surface 1004 can include a raised section of a height H. As shown in FIG. 10, the top surface 1004 can include a substantially concave surface. In other examples, the top surface 1004 can include a substantially flat or convex surface.

In various examples, the end piece 1000 can include a linking member 1008, similar to linking member 108/208/316/406/606. The linking member 1008 can comprise a hole, a slot, or another type of pass-through. The linking member 1008 can be substantially rectangular, ovular, circular, square, or another shape capable of housing a coupling element. The coupling element can include a strap, webbing, rope, twine, or another material used for securing equipment. For example, a strap can be fed though the linking members of two end pieces to create a carrying strap for a guitar (110 of FIG. 1).

Conclusion

Although implementations have been described in language specific to structural feature, it is to be understood that the disclosure is not necessarily limited to the specific features or acts described. Rather, the specific features and acts are disclosed as illustrative forms of employing the implementations. For example, in various implementations, any of the structural features and/or methodological acts described herein may be rearranged, modified, or omitted entirely.

The particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which the physical element facilitates. As but one example, the disclosure of a "coupling" should be understood to encompass disclosure of the act of "coupling"—whether explicitly discussed or not—and, conversely, were there effectively disclosure of the act of "coupling", such a disclosure should be understood to encompass disclosure of a "coupling" and even a "means for coupling." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

What is claimed is:

1. An end piece for releasably securing to a coupling element comprising:

an outer body surrounding a first aperture and a second aperture, the first aperture defined by a plurality of projection elements extending radially inward from the outer body, the plurality of projection elements to secure the coupling element in the first aperture; and an inner body arranged in the outer body, the inner body comprising two catch elements arranged opposite one another and defining the second aperture, the two catch elements to secure the coupling element in the second aperture.

2. The end piece as claim 1 recites, wherein the outer body further comprises a linking member to couple to a strap.

3. The end piece as claim 2 recites, wherein the linking member comprises an elongated slot arranged in an end of the outer body.

4. The end piece as claim 1 recites, wherein the outer body is over-molded to the inner body.

5. The end piece as claim 4 recites, wherein the outer body comprises a thermoplastic elastomer and the inner body comprises a nylon.

6. The end piece as claim 1 recites, further comprising a friction material arranged on a bottom side of the outer body, the friction material comprising at least one of:

a rubber;

a polyurethane;

a silicone;

a polypropelene;

a polyethylene; or a nylon.

7. The end piece as claim 1 recites, wherein the end piece comprises a length of about 2¾ inches.

8. The end piece as claim 2 recites, wherein the outer body comprises:

a first section having a width of about 2½ inches and comprising the linking member; and a second section having a width of about 1⅜ inches, the second section comprising the first aperture and the second aperture.

9. The end piece as claim 8 recites, wherein:

the first section has a height of about ½ inches; and the second section has a height of about ⅜ inches.

10. An end piece for releasably securing to a coupling element comprising:

a body comprising:

a first aperture configured to vertically accept the coupling element and prevent the end piece from moving in a vertical direction with respect to the coupling element absent a threshold vertical force applied to the end piece, wherein the first aperture is defined by a plurality of projection elements arranged radially inward from an inside perimeter of the first aperture, the plurality of projection elements configured to secure the end piece to the coupling element in the first aperture; and a second aperture configured to laterally accept the coupling element and prevent the end piece from moving:

in a lateral direction with respect to the coupling element, absent a threshold lateral force being applied to the end piece; and in the vertical direction with respect to the coupling element, such that the end piece does not move from a first position secured in the second aperture to a second position secured in the first aperture.

11. The end piece as claim 10 recites, wherein the second aperture is defined by at least two catch elements arranged opposite one another and configured to secure the end piece to the coupling element absent the threshold lateral force applied to the end piece.

12. The end piece as claim 10 recites, further comprising an inner body fixed in the body, and the second aperture is arranged in the inner body such that the second aperture is surrounded on three sides by the inner body.

13. The end piece as claim 12 recites, wherein the inner body comprises a nylon material, and the body is over-molded to the inner body.

14. The end piece as claim 10 recites, further comprising:

a linking element to couple a strap to the end piece.

15. The end piece as claim 10 recites, wherein:

the threshold vertical force is at least about 10 pounds to at most about 20 pounds of force; and the threshold lateral force is at least about 10 pounds and at most about 15 pounds of force.

16. A kit for releasably securing a strap to a guitar comprising:

a first end piece and a second end piece, at least one of the first end piece or the second end piece comprises:

an outer body surrounding a first aperture and a second aperture, the outer body comprising a plurality of projection elements arranged radially inward from the outer body and defining the first aperture;

an inner body mounted within the outer body, the inner body comprising two catch elements, the two catch elements defining the second aperture, wherein the first aperture is configured to receive a coupling element of the guitar, and the second aperture is configured to prevent a lateral release and a vertical release of the coupling element; and a linking member configured to secure an end of the strap, wherein the first end piece secures to a first coupling element of the guitar and a first end of the strap, and the second end piece secures to a second coupling element of the guitar and a second end of the strap.

17. The kit as claim 16 recites, wherein the outer body is over-molded to the inner body.

18. The kit as claim 16 recites, wherein the plurality of projection elements are configured to secure the coupling element of the guitar within the first aperture absent a threshold amount of a vertical force applied to the outer body.

19. The kit as claim 16 recites, wherein the two catch elements are configured to secure the coupling element of the guitar within the second aperture absent a threshold amount of a lateral force applied to the outer body.

* * * * *